US007557760B2

(12) United States Patent
Chang et al.

(10) Patent No.: US 7,557,760 B2
(45) Date of Patent: Jul. 7, 2009

(54) INVERTED-F ANTENNA AND MOBILE COMMUNICATION TERMINAL USING THE SAME

(75) Inventors: Ki Won Chang, Gyunggi-do (KR); Duk Woo Lee, Gyunggi-do (KR); Jeong Sik Seo, Daejeon (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 132 days.

(21) Appl. No.: 11/797,536

(22) Filed: May 4, 2007

(65) Prior Publication Data

US 2007/0262909 A1 Nov. 15, 2007

(30) Foreign Application Priority Data

May 4, 2006 (KR) ..... 10-2006-0040486

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS 5,966,097 A * 10/1999 Fukasawa et al. ..... 343/700 MS
6,980,165 B2 * 12/2005 Yuasa et al. ..... 343/718
7,330,154 B2 * 2/2008 Kanazawa ..... 343/702
2003/0001780 A1 * 1/2003 Hill et al. ..... 343/700 MS
2004/0137950 A1 * 7/2004 Bolin et al. ..... 455/562.1
2006/0139214 A1 6/2006 Deng et al.

FOREIGN PATENT DOCUMENTS

GB 2 417 834 A 8/2006
WO 02-078123 A1 10/2002

OTHER PUBLICATIONS

UK Intellectual Property Office, Search Report mailed Aug. 23, 2007.

* cited by examiner

*Primary Examiner*—Tho G Phan
(74) *Attorney, Agent, or Firm*—Lowe Hauptman Ham & Berner

(57) ABSTRACT

An inverted-F antenna and a mobile communication terminal using the same. The antenna includes a flexible board and a radiation plate formed on the flexible board. The antenna further includes a signal line having a first end formed on the flexible board and connected to the radiation plate and a second end extending from the first end and provided as a connecting terminal for feeding and grounding. The mobile communication terminal includes an RF board, a ground plate formed on the RF board, a feed line formed on the RF board for supplying a signal, and the inverted-F antenna as described above.

18 Claims, 7 Drawing Sheets
(1 of 7 Drawing Sheet(s) Filed in Color)

INVERTED-F ANTENNA AND MOBILE COMMUNICATION TERMINAL USING THE SAME

CLAIM OF PRIORITY

This application claims the benefit of Korean Patent Application No. 2006-0040486 filed on May 4, 2006, in the Korean Intellectual Property Office, the disclosure of which is incorporated herein by reference.

BACKGROUND OF THE INVENTION

1. Field of the Invention

The present invention relates to an antenna for a mobile communication terminal and, more particularly, to an inverted-F antenna, in which a feeder and a ground are integrally formed, and a mobile communication terminal using the same.

2. Description of the Related Art

With recent popularization of portable wireless terminals including GPS, PDA, cellular phone and the like, terminals with diverse functions and designs are introduced. In addition, as the terminals have miniaturized and slimmer designs, the importance in diversity of the functions of the terminals has been emphasized more than ever.

In particular, as the conventional rod antenna and helical antenna protrude out of the terminal in a predetermined length, the likelihood of damage is increased when the terminal is dropped, which in turn degrades portability. Therefore, planar internal antennas, which are mounted inside the terminals, have been recently introduced.

The inverted-F antenna is connected vertically to a board, and has a protrusion extending from a longitudinal middle part thereof to be parallel with the board, in which a feeder is connected to a portion of the antenna opposing the board.

FIGS. 1 and 2 are plan views illustrating a conventional inverted F-antenna and a mobile communication terminal using the same, according to the prior art (Korea Patent Application No. 2003-0075469, entitled "Inverted F-Antenna Using FPCB and Mobile Communication Terminal with the Inverted-F Antenna").

Referring to FIG. 1, the inverted-F antenna 10 has its conductive line 11 disposed in a shape similar to an alphabet 'F' on a Flexible Printed Circuit Board (FPCB) 12. The line 11 of the inverted-F antenna 10 has one end connected to a transceiver 13*b* which is a signal applier. The line 11 extends in a straight line along the longitudinal direction of the FPCB and is bent in a vertical direction, and then is bent in vertical and horizontal directions for multiple times. A matching circuit 11M is formed at the portion of the line 11 extending along the longitudinal direction of the FPCB 12 and connected to the substrate 13*a*.

The part where the antenna is bent for multiple times is called a "radiator" 14, which generates a resonant frequency and multi-band according to the interval between the lines 11R, the width of the line 11R and the size of the radiator 14.

This kind of antenna structure, however, has a problem in that bending and mounting the antenna cause changes in the characteristics of the antenna since the signal line and the ground line are made separate from each other.

FIG. 2 is a plan view illustrating the inverted-F antenna disposed on the substrate and mounted in a folder-type mobile communication terminal.

Inside the mobile communication terminal body 28, the inverted-F antenna 10 is installed in parallel with the substrate 25.

This mounting structure of the antenna is mainly focused on reducing the thickness of the terminal, but in practice, as the antenna mounting space occupies a relatively large area, the miniaturization of the terminal is limited. Furthermore, as the antenna is installed in parallel with an RF board, the operation of the antenna is interfered by the terminal body or the metal portions (key pad assembly, LCD module, etc.) of the folder, hindering adequate antenna radiation characteristics.

SUMMARY OF THE INVENTION

The present invention has been made to solve the foregoing problems of the prior art and therefore an aspect of the present invention is to provide an antenna which is less susceptible to the changes in an external environment.

Another aspect of the invention is to provide a mobile communication terminal which has a minimal mounting area of an antenna and minimizes interference by surrounding metal devices.

According to an aspect of the invention, the invention provides an inverted-F antenna, which includes a flexible board; a radiation plate formed on the flexible board; and a signal line having a first end formed on the flexible board and connected to the radiation plate and a second end extending from the first end and provided as a connecting terminal for feeding and grounding.

Preferably, the signal line may have a bending part formed between the first end and the second end.

Preferably, a portion of the flexible board corresponding to the bending part may have a smaller thickness than other portions.

Preferably, the second end of the signal line may have a feed terminal and a ground terminal formed at a same position.

Preferably, the second end of the signal line may have a feed terminal and a ground terminal formed at a predetermined interval from each other.

Preferably, the signal line may be positioned at a right angle about the radiation plate with the first end thereof connected to a side of the radiation plate.

The inverted-F antenna may further include a connector for connecting the first end of the signal line with the radiation plate, the connector having a width smaller than that of the signal line.

Preferably, the flexible board may have a right-angled shape according to connection form of the signal line and the radiation plate.

The inverted-F antenna may further include a stub extending from the first end of the signal line for impedance matching, and preferably, the stub extends in an opposite direction from the extension direction of the signal line.

According to anther aspect of the invention, the invention provides a mobile communication terminal, which includes an RF board; a ground plate formed on the RF board; a feed line formed on the RF board for supplying a signal; and an inverted-F antenna including a flexible board, a radiation plate formed on the flexible board, and a signal line having a first end formed on the flexible board and connected to the radiation plate and a second end extending from the first end and connected to the ground plate and the feed line.

Preferably, the inverted-F antenna may be mounted at a side of the RF board with the signal line bent in such a way that the radiation plate is disposed perpendicular to a main surface of the RF board.

The RF board may have a recess for mounting the bent flexible board including the radiation plate.

Preferably, the flexible board may have a surface fixed to internal devices of the mobile communication terminal by an adhesive material.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The patent or application file contains at least on drawing executed in color. Copies of this patent or patent application publication with color drawing(s) will be provided by the Office upon request and payment of the necessary fee.

Figure 1:
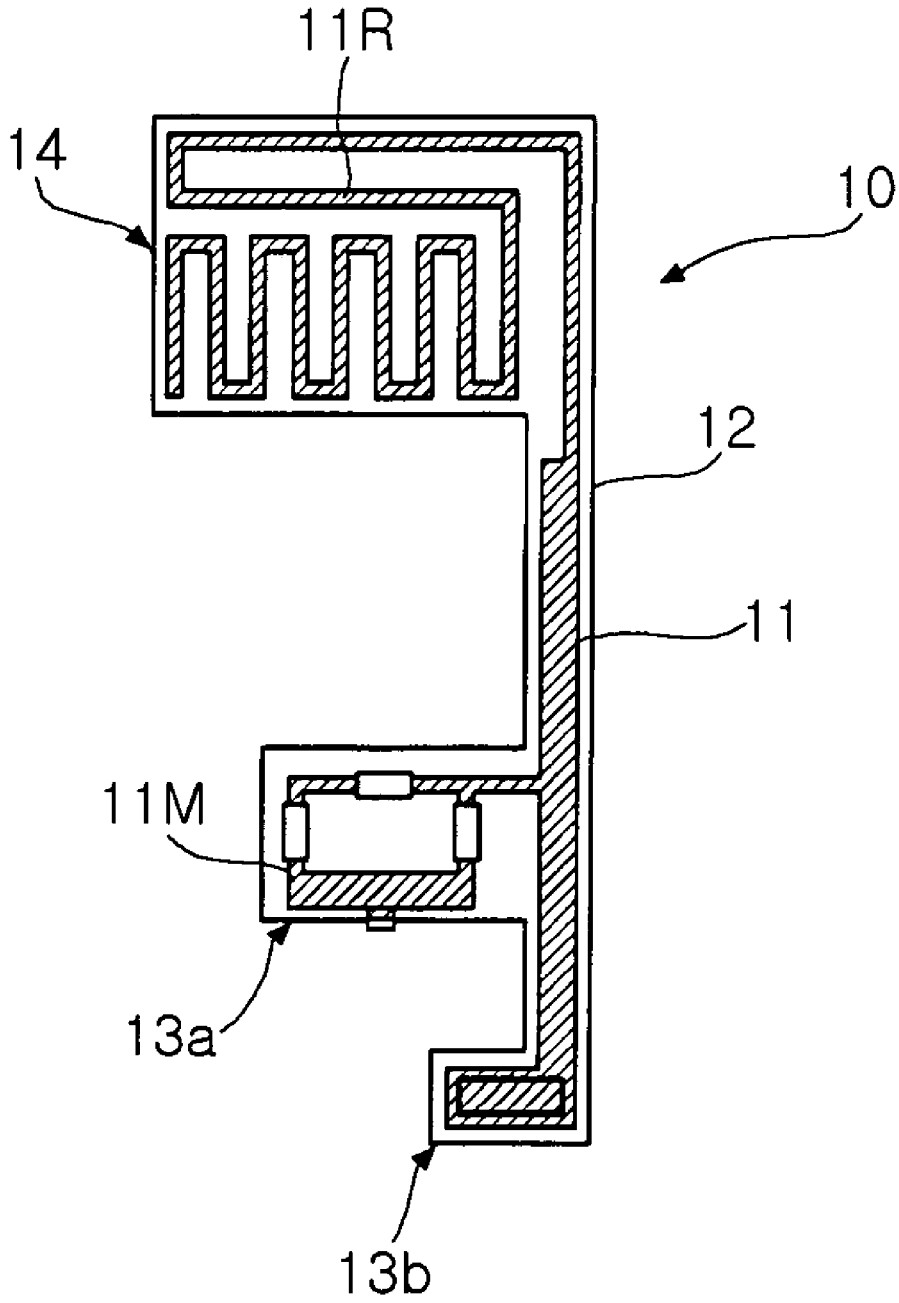
PRIOR ART FIG. 1
Figure 2:
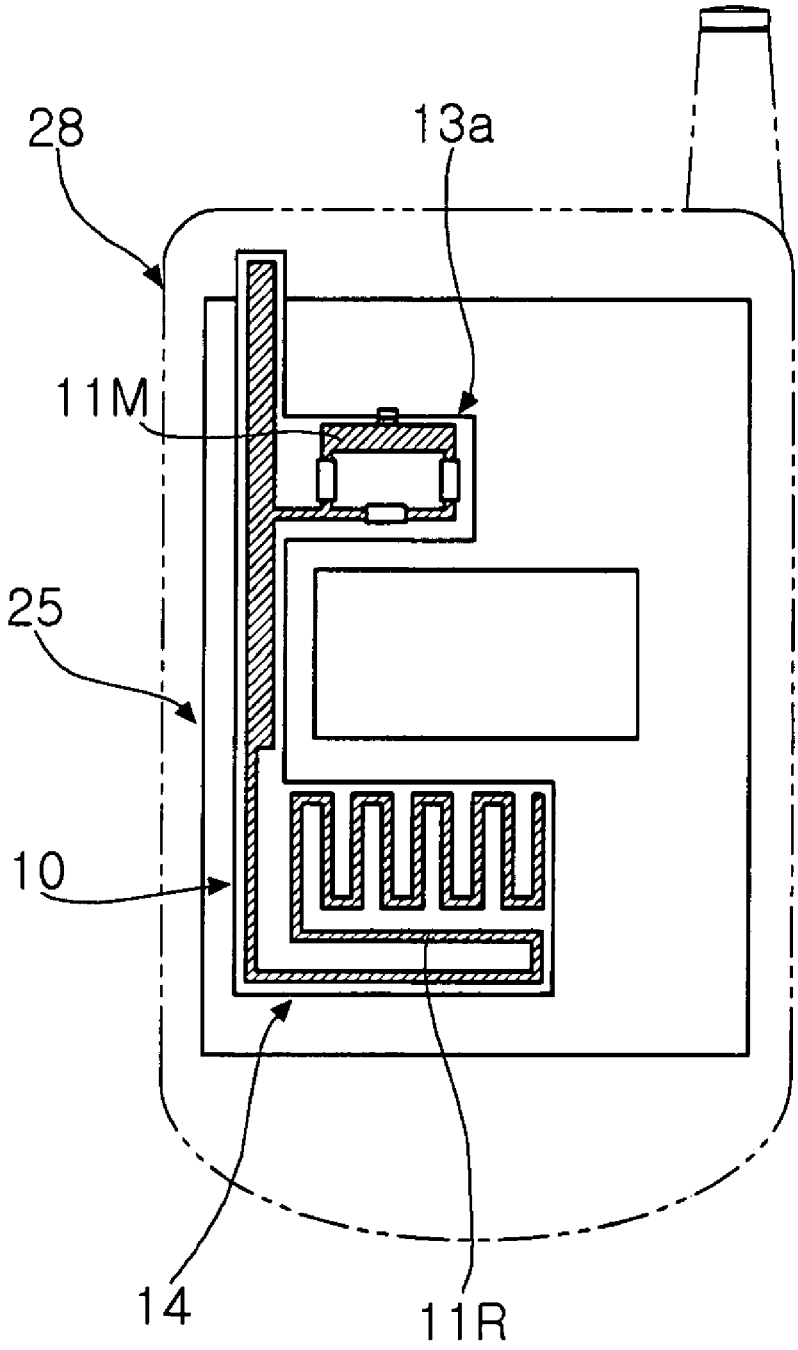
PRIOR ART FIG. 2
Figure 3A:
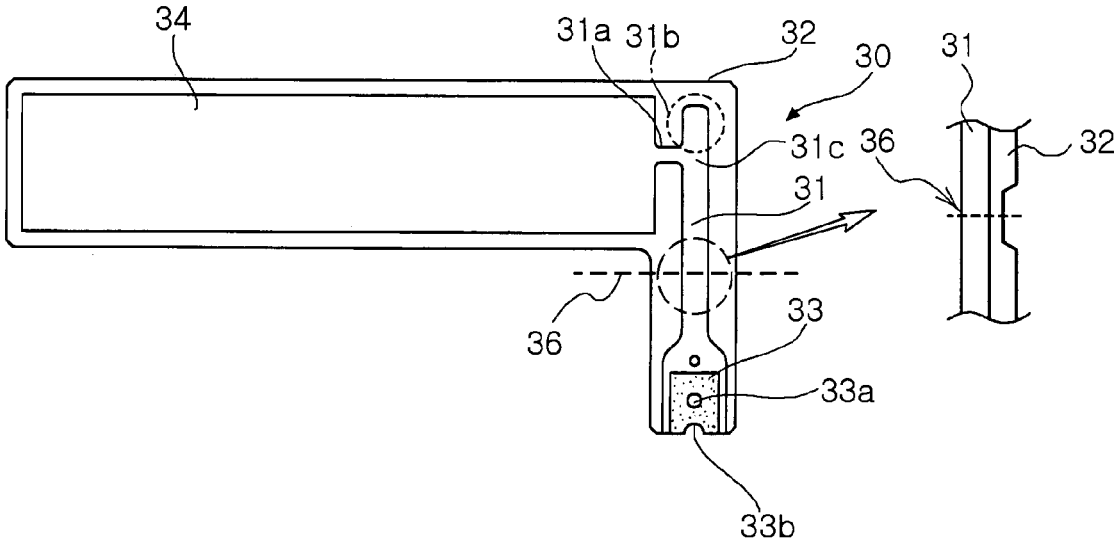
Figure 3B:
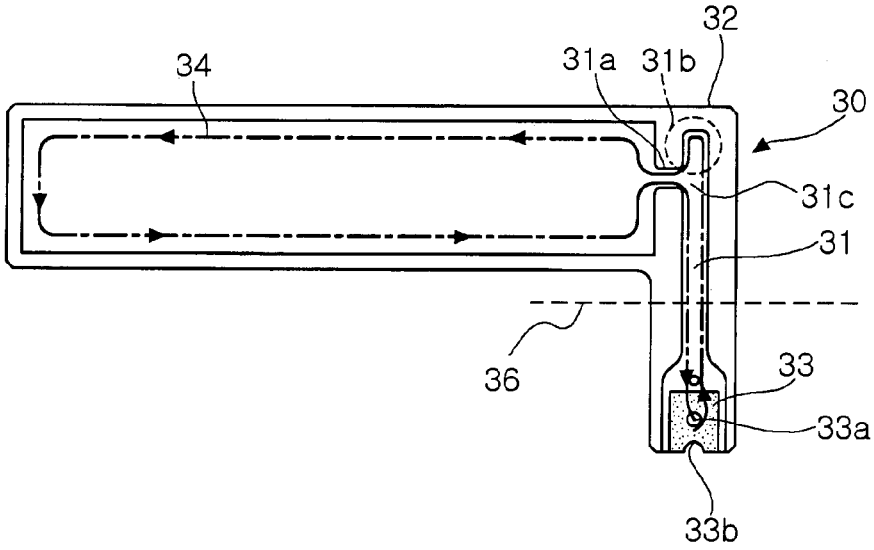
Figure 4A:
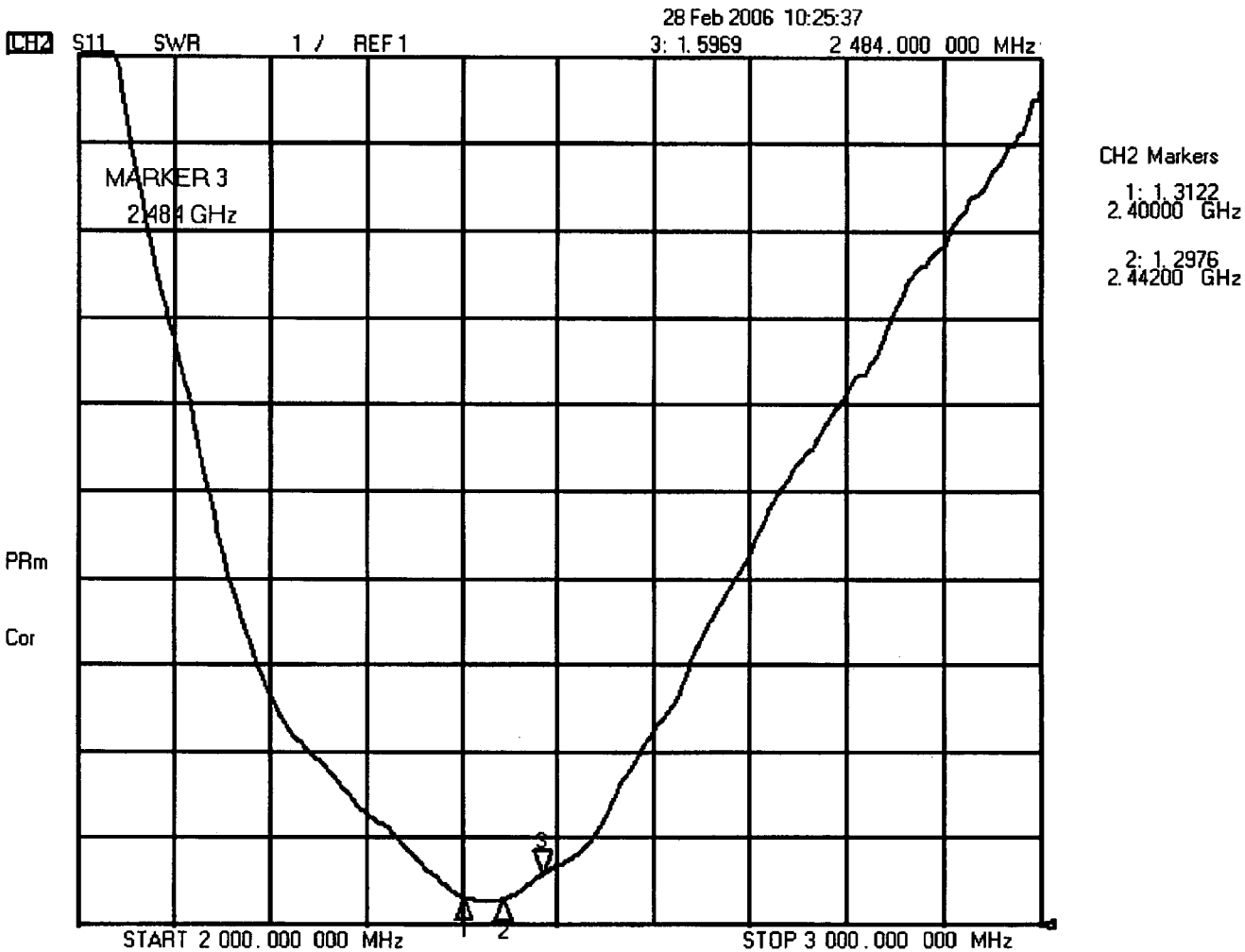
Figure 4B:
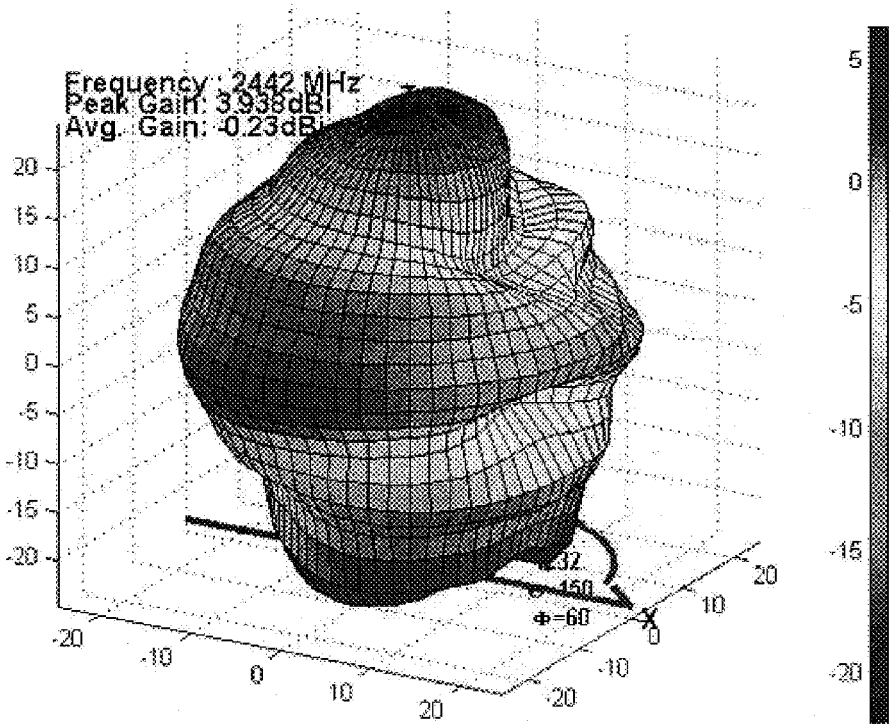
Figure 5A:
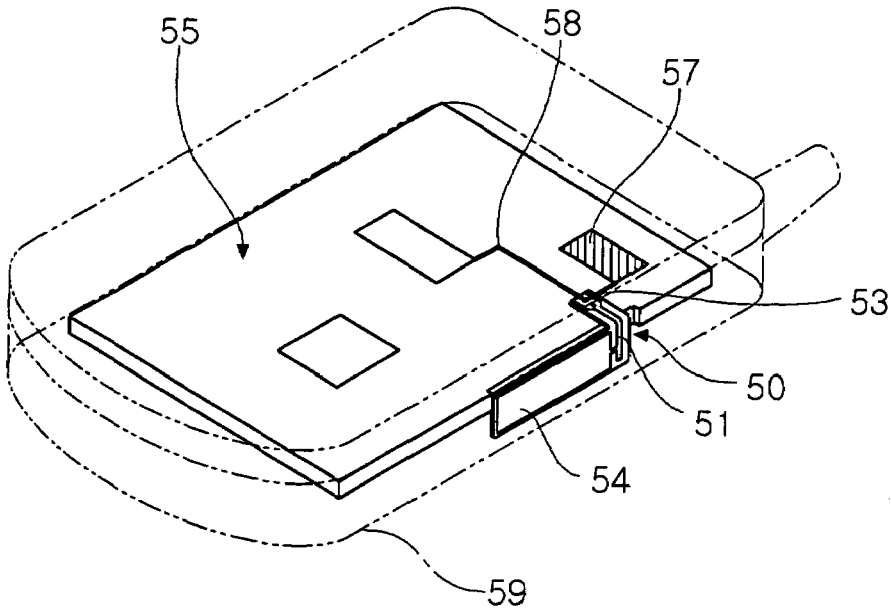
Figure 5B:
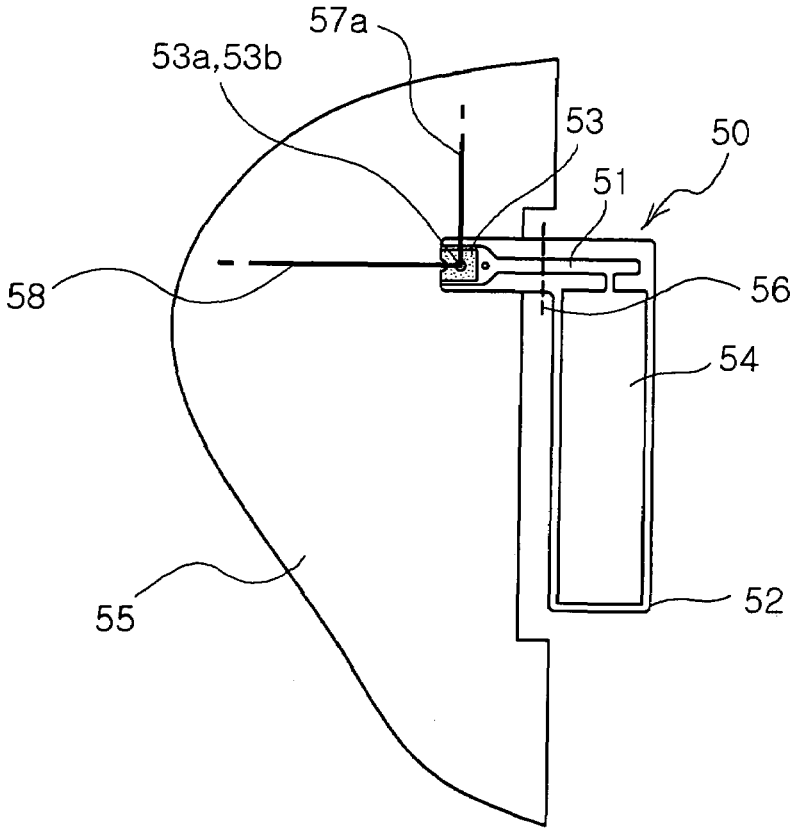
Figure 6A:
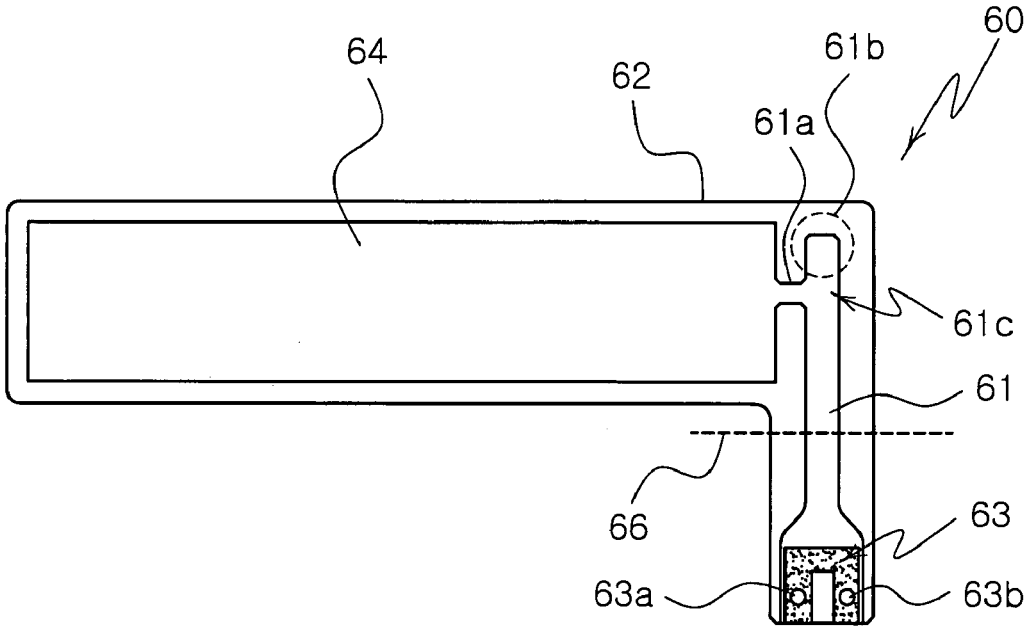
Figure 6B:
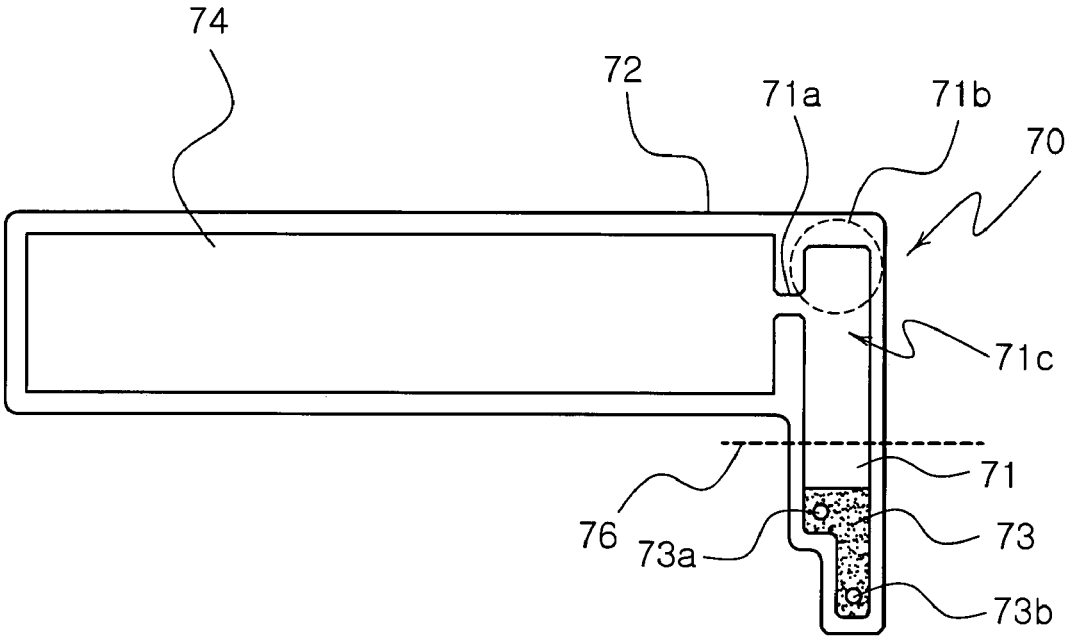

The above and other aspects, features and other advantages of the present invention will be more clearly understood from the following detailed description taken in conjunction with the accompanying drawings, in which:

FIG. 1 is a plan view illustrating a conventional inverted-F antenna using an FPCB;

FIG. 2 is a plan view illustrating the conventional antenna of FIG. 1 mounted inside a mobile communication terminal;

FIG. 3*a* is a plan view illustrating an inverted-F antenna according to the present invention, and FIG. 3*b* is a view illustrating the flow of the current in side the inverted-F antenna according to the present invention;

FIG. 4*a* is a graph illustrating the voltage standing wave ratio of the antenna and FIG. 4*b* is a graph showing the radiation pattern of the antenna according to an embodiment of the present invention;

FIGS. 5*a* and 5*b* are a perspective view and an enlarged plan view, respectively, illustrating a mobile communication terminal having the antenna according to an embodiment of the present invention mounted therein; and FIGS. 6*a* and 6*b* are plan views illustrating an inverted-F antenna according to other embodiments of the present invention.

DETAILED DESCRIPTION OF THE PREFERRED EMBODIMENT

Exemplary embodiments of the present invention will now be described in detail with reference to the accompanying drawings.

FIGS. 3*a* and 3*b* are plan views illustrating a planar antenna according to an embodiment of the present invention.

Referring to FIG. 3*a*, the planar antenna 30 according to an embodiment of the present invention includes a flexible board 32 with a radiation plate 34 and a signal line 31 formed thereon.

The signal line 31 includes a first end 31*c* connected to the radiation plate 34 via a connector 31*a*. In addition, the signal line 31 includes a second end 33 where a ground terminal 33*a* and a feed terminal 33*b* are formed. The ground terminal 33*a* is connected to a ground plate outside, and the feed terminal 33*b* is connected to a feed line outside.

The radiation plate 34 is connected vertically to the signal line 31.

At this time, a stub 31*b* is formed in the opposite direction from the extension direction of the signal line 31 for impedance matching between the radiation plate 34 and the signal line 31. Here, the stub can be formed in various thicknesses and lengths.

FIG. 3*a* exemplifies an open stub, which operates as an inductor with its length L satisfying the relation $\lambda/4<L<\lambda/2$, and as a capacitor with its length L satisfying the relation $L<\lambda/4$.

In addition, the connector 31*a* connecting the radiation plate 34 and the signal line 31 has a width smaller than that of the signal line 31. This is for impedance matching effect when the signal line 31 and the radiation plate 34 come in contact with each other.

FIG. 3*a* exemplifies a planar radiation plate. The length and the width of the radiation plate 34 can be adjusted to vary the frequency characteristics thereof.

A slot can be formed in the planar radiation plate, which increases the length of the antenna, allowing lower frequency band characteristics than the planar radiation plate without a slot. The length, direction and the width of the slot engraved in the radiation plate can be adjusted to also realize high frequency band characteristics.

As described above, the radiation pattern formed on the radiation plate 34 can be adjusted to determine the frequency band and the resonant frequency of the antenna.

In the meantime, a conductor may be attached on the radiation plate 34 to achieve superior radiation characteristics.

FIG. 3*b* illustrates the flow path of the current supplied to the antenna.

The current supplied from the feed terminal 33*b* of the antenna passes through the signal line 31, the stub 31*b* and the connector 31*a* to be transmitted to the radiation plate 34.

With the current flown to the radiation plate 34, the radiation plate 34 radiates an electric wave of a high frequency signal or a low frequency signal.

The antenna pattern can be modified by the length or width of the radiation plate, and the slot formed in the radiation plate, etc., which in turn alters the flow path of the current in the radiation plate. Consequently, this alters the characteristics of the electric wave radiated by the radiation plate. Therefore, the antenna characteristics can be changed by tuning the radiation plate.

The current passed through the radiation plate 34 passes through the connector 31*a* and the signal line 31 and is flown to the ground terminal 33*a*.

As shown in FIGS. 3*a* and 3*b*, in this embodiment, the feed terminal 33*b* and the ground terminal 33*a* can be formed at the second end 33 of the signal line. In a typical inverted-F antenna, the feed terminal and the ground terminal are separately connected to the radiation line. Thus, the interval between the feed and ground terminals, physical alteration of the feed and ground terminals, etc. are the parameters affecting the antenna characteristics, which should be considered in designing the antenna. As the antenna characteristics are changed in accordance with the mounting structure and location of the antenna inside the terminal, it is required to physically modify or make the feed terminal and the ground terminal complement each other in connection with the physical alteration of the radiation plate or the changes in the frequency characteristics.

Although this embodiment is exemplified by an inverted-F structure, the feed terminal 33*b* and the ground terminal 33*a* are formed at one end 33 of the signal line, and the signal is transmitted to the radiation plate via the signal line. As the feed terminal 33*b* and the ground terminal 33*a* are electrically connected (or short-circuited) at the one end 33 of the signal line 31, the signal is transmitted via the signal line 31 to the radiation plate connected to the other end 31*c* of the signal line. The antenna according to this embodiment is bent at a bending part 36 formed at the signal line when it is mounted to a side of the RF board. That is, physical alteration takes place. Even if the antenna is bent at the bending part 36, only the signal line 31 is affected by the physical alteration, and the feed terminal 33*b* and the ground terminal 33*a* connected to the second end 33 of the signal line are not affected by the physical alteration. Therefore, the physical alteration of the antenna does not have a significant effect on the antenna characteristics in this embodiment.

Therefore, when the antenna 30 according to this embodiment is mounted in the mobile communication terminal, only the radiation plate 34 can be adjusted to obtain the desired frequency characteristics. In addition, the antenna characteristics are less susceptible to the changes in the external environment.

As described above, the location of the feed terminal and the ground terminal can be freely selected as long as the feed terminal and the ground terminal are connected to the one end of the signal line so that only the signal line is physically altered, and the feed terminal and the ground terminal are not affected by the physical alteration. In this embodiment, the ground terminal and the feed terminal are disposed apart at a predetermined interval within the second end 33, but they can also be formed at the same location. In addition, as long as free from the affect of the physical alteration by the bending the antenna at the bending part, the ground terminal and the feed terminal can be disposed farther apart from each other.

The antenna is formed on the flexible board 32. This advantageously allows mounting the antenna by bending at the bending part 36 inside the mobile communication terminal. FIG. 3*a* shows a sectional view of the bending part of the flexible board. The portion of the flexible board 32 corresponding to the bending part 36 can be formed to have a smaller thickness than other portions. A double-coated tape or an adhesive material can be applied on a surface of the board 32 to fix the antenna to a side of the RF board or internal devices when the antenna is mounted inside the mobile communication terminal. Fixing the antenna to the internal devices prevents the antenna from being shifted in its position by the external impacts, thereby realizing stable frequency characteristics.

FIG. 4*a* is a graph illustrating the standing wave ratio of the antenna shown in FIG. 3.

FIG. 4*a* shows the values obtained from an experiment conducted on an antenna with a radiation plate having a length of 13 mm and a width of 3.2 mm, a flexible board having a length of 14.7 mm, and a signal line having a length of 6.9 mm.

FIG. 4*a* shows the standing wave ratio of the antenna. Referring to FIG. 4*a*, when the standing wave ratio is the smallest, the power supplied to the antenna is most effectively radiated, and the frequency at this time is the resonant frequency of the antenna.

As shown in FIG. 4*a*, the frequency is 2.44 GHz when the standing wave ratio is the smallest, which corresponds to the resonant frequency of the antenna.

FIG. 4*b* is a graph illustrating the radiation characteristics at the resonant frequency of the antenna measured in FIG. 4*a*.

Referring to FIG. 4*b*, at 2.442 GHz, the maximum peak gain is 3.938 dBi, and the average gain is −0.23 dBi.

FIG. 5*a* is a perspective view illustrating a structure in which the antenna according to an embodiment of the present invention is mounted to a side of the RF board and mounted in a mobile communication terminal.

The antenna 50 is mounted to the side of the RF board 55 with the signal line 51 bent in such a way that the planar radiation plate 54 is disposed perpendicular to the main surface of the RF board 55.

The feed line 58 formed on the RF board 55, and the ground line connected to the ground plate 57, are connected to one end 53 of the signal line 51.

As described above, according to an exemplary embodiment of the present invention, even when the antenna is bent and mounted in the terminal, since both the ground terminal and the feed terminal are formed at the one end 53 of the signal line 51, only the signal line 51 can be bent without affecting the ground terminal and the feed terminal, thereby not causing any changes in the antenna characteristics.

It is preferable that a double-coated tape or an adhesive material is applied on a surface of the flexible board 52 so that the antenna 50 is fixed to the side of the RF board 55 and to the internal devices as the antenna is mounted in the mobile communication terminal 58. Fixing the antenna to the internal devices prevents the antenna from being shifted in its location by the external impacts, realizing stable frequency characteristics.

In general, the RF board 55 can be provided to a terminal body 59 apart from a peripheral area thereof, so that this area can be utilized to mount the planar antenna, further reducing the mounting area of the antenna.

In addition, as the antenna 50 is mounted perpendicular to the RF board 55, the electromagnetic wave generated from the radiation plate 54 is less affected by the devices on the RF board or the metal parts mounted in the terminal body, thereby achieving more effective radiation characteristics.

FIG. 5*b* is an enlarged plan view of a structure of FIG. 5*a*, in which the antenna is mounted to the RF board, but prior to bending of the antenna.

Referring to FIG. 5*b*, the antenna is mounted such that the ground line 57*a* and the feed line 58 on the RF board 55 (partially shown) come in contact with the second end 53 of the signal line 51. In this embodiment, unlike in the embodiment shown in FIG. 3, the feed line 58 and the ground line 57*a* are connected to the same location 53*a*, 53*b* of the second end 53 of the signal line.

At the side of the RF board 55 is formed a recess for mounting the antenna. When the RF board 55 and the antenna 50 are mounted inside the terminal, the antenna is bent at the bending part 56 of the signal line 31 in such a way that the radiation plate 54 of the antenna forms a right angle with the main surface of the RF board.

As described above, the ground line 57*a* and the feed line 58 are connected to the one end 53 of the signal line of the antenna, thereby physically altering only the signal line 51 without affecting the ground line and the feed line connected to the antenna when the antenna is mounted in the terminal. This minimizes the changes in the antenna characteristics due to the physical alteration of the antenna. In this embodiment, the ground line and the feed line are connected to the same location 53*a*, 53*b*, but as long as the feed line and the ground line are not affected by the bending at the bending part 56, the locations at which the ground line and the feed line are connected to the end of the signal line can be spaced apart at a predetermined interval.

The recess formed in the RF board 55 provides a space in which the antenna is bent and mounted and also an interval at which the radiation plate 54 and the RF board 55 can be disposed apart. When the antenna 50 is mounted in a bent position, the interval between the radiation plate 54 and the RF board serves to mitigate the interference by other devices on the RF board 55 with regard to the antenna characteristics. Preferably, a shield can be formed between the RF board 55 and the radiation plate 54.

FIGS. 6*a* and 6*b* are plan views illustrating an antenna according to other embodiments of the present invention.

Referring to FIGS. 6*a* and 6*b*, the planar antenna 60, 70 includes the flexible board 62, 72 with the radiation plate 64, 74 and the signal line 61, 71 formed thereon.

The first end 61*c*, 71*c* of the signal line 61, 71 is connected to the radiation plate 64, 74 via the connector 61*a* and 71*a*, and the ground terminal 63*a*, 73*a* and the feed terminal 63*b*, 73*b* are formed at the second end 63, 73 of the signal line 61, 71. The ground terminal 63*a*, 73*a* is connected to a ground plate outside, and the feed terminal 63*b* and 73*b* is connected to a feed line outside.

In this embodiment, the ground terminal and the feed terminal are formed apart at a predetermined interval at the second end of the signal line, unlike in the embodiment shown in FIG. 3.

The radiation plate, the stub and the signal line are identical to those in the embodiment shown in FIG. 3.

This embodiment is exemplified by the antenna having an inverted-F structure, but the feed terminal 63*b*, 73*b* and the ground terminal 63*a*, 73*a* are positioned apart at a predetermined interval within one end 63, 73 of the signal line, and the signal is transmitted through the signal line to the radiation plate. Although the feed terminal 63*b*, 73*b* is disposed apart at a predetermined interval from the ground terminal 63*a*, 73*a* within the one end 63, 73 of the signal line 61, 71, they are electrically connected (or short-circuited) and thus the signal propagates through the signal line 61, 71 to the radiation plate connected to the other end 61*c*, 71*c* of the signal line. In this embodiment, the antenna is bent at the bending part 66, 72 formed at the signal line when it is mounted to the side surface of the RF board. That is, physical alteration takes place. Even if the antenna is bent at the bending part 66, 76, physical alteration occurs only at the signal line 61, 71 while the feed terminal 63*b*, 73*b* and the ground terminal 63*a*, 73*a* connected to the second end 63, 73 of the signal line are not affected by the physical alteration. Therefore, the physical alteration of the antenna does not have a significant affect on the antenna characteristics.

Therefore, when the antenna 60, 70 according to this embodiment is mounted in the mobile communication terminal, only the radiation plate 64, 74 can be adjusted to realize the desired frequency characteristics. In addition, the antenna characteristics are less susceptible to the changes in the external environment.

The present invention as set forth above provides an antenna with its characteristics less affected by the changes in the external environment, and provides a mobile communication terminal that has a minimal mounting area of the antenna and can minimize the interference by surrounding metal devices.

While the present invention has been shown and described in connection with the exemplary embodiments, it will be apparent to those skilled in the art that modifications and variations can be made without departing from the spirit and scope of the invention as defined by the appended claims.

What is claimed is:

1. An inverted-F antenna comprising:

a flexible board;

a radiation plate formed on the flexible board; and a signal line comprising a first end formed on the flexible board and connected to the radiation plate and a second end extending from the first end and provided as a connecting terminal for feeding and grounding;

wherein the signal line has a bending part formed between the first end and the second end; and wherein a portion of the flexible board corresponding to the bending part has a smaller thickness than other portions of the flexible board.

2. The inverted-F antenna according to claim 1, wherein the second end of the signal line has a feed terminal and a ground terminal formed at a same position.

3. The inverted-F antenna according to claim 1, wherein the second end of the signal line has a feed terminal and a ground terminal formed at a predetermined interval from each other.

4. The inverted-F antenna according to claim 1, further comprising a stub extending from the first end of the signal line for impedance matching.

5. The inverted-F antenna according to claim 4, wherein the stub extends in an opposite direction from the extension direction of the signal line.

6. An inverted-F antenna comprising:

a flexible board;

a radiation plate formed on the flexible board; and a signal line comprising a first end formed on the flexible board and connected to the radiation plate and a second end extending from the first end and provided as a connecting terminal for feeding and grounding;

wherein the signal line is positioned at a right angle about the radiation plate with the first end thereof connected to a side of the radiation plate.

7. The inverted-F antenna according to claim 6, further comprising a connector for connecting the first end of the signal line with the radiation plate, the connector having a width smaller than that of the signal line.

8. The inverted-F antenna according to claim 6, wherein the flexible board has a right-angled shape according to connection form of the signal line and the radiation plate.

9. A mobile communication terminal comprising:

an RF board;

a ground plate formed on the RF board;

a feed line formed on the RF board for supplying a signal; and an inverted-F antenna including a flexible board, a radiation plate formed on the flexible board, and a signal line having a first end formed on the flexible board and connected to the radiation plate and a second end extending from the first end and connected to the ground plate and the feed line;

wherein the inverted-F antenna is mounted at a side of the RF board with the signal line bent in such a way that the radiation plate is disposed perpendicular to a main surface of the RF board.

10. The mobile communication terminal according to claim 9, wherein the RF board has a recess for mounting the bent flexible board including the radiation plate.

11. The mobile communication terminal according to claim 9, wherein the flexible board has a surface fixed to internal devices of the mobile communication terminal by an adhesive material.

12. The mobile communication terminal according to claim 9, wherein the second end of the signal line has a feed terminal and a ground terminal formed at a same position.

13. The mobile communication terminal according to claim 9, wherein the second end of the signal line has a feed terminal and a ground terminal formed at a predetermined interval from each other.

14. The mobile communication terminal according to claim 9, the signal line is positioned at a right angle about the radiation plate with the first end thereof connected to a side of the radiation plate.

15. The mobile communication terminal according to claim 9, further comprising a connector for connecting the first end of the signal line with the radiation plate, the connector having a width smaller than that of the signal line.

16. The mobile communication terminal according to claim 9, wherein the flexible board has a right-angled shape according to connection form of the signal line and the radiation plate.

17. The mobile communication terminal according to claim 9, further comprising a stub extending from the first end of the signal line for impedance matching.

18. The mobile communication terminal according to claim 17, wherein the stub extends in an opposite direction from the extension direction of the signal line.

* * * * *